US005356517A

United States Patent [19]

Pedersen et al.

[11] Patent Number: 5,356,517

[45] Date of Patent: Oct. 18, 1994

[54] HYDROLYSIS OF RESIN IN PULP WITH AN ENZYME AND A PEROXIDE

[75] Inventors: Lars S. Pedersen, Lyngby; Steen Skjold-Jorgensen, Horsholm, both of Denmark

[73] Assignees: Novo Nordisk A/S, Bagsvaerd, Denmark; SCA Wifsta-Östrand AB, Timraa, Sweden

[21] Appl. No.: 848,973

[22] PCT Filed: Nov. 7, 1990

[86] PCT No.: PCT/DK90/00282

§ 371 Date: Apr. 16, 1992

§ 102(e) Date: Apr. 16, 1992

[87] PCT Pub. No.: WO91/07542

PCT Pub. Date: May 30, 1991

[30] Foreign Application Priority Data

Nov. 8, 1989 [DK] Denmark ..... 5561/89
Jan. 10, 1990 [SE] Sweden ..... 9000077-9

[51] Int. Cl.[5] ..... D21C 9/16

[52] U.S. Cl. ..... 162/72; 162/24; 162/78; 435/277; 435/278

[58] Field of Search ..... 162/24, 71, 72, 78; 435/277, 278

[56] References Cited

U.S. PATENT DOCUMENTS 3,486,969 12/1969 Nilsson et al. ..... 162/72
3,486,989 12/1969 Nilsson et al. ..... 162/DIG. 12
4,922,989 5/1990 Backlund et al. ..... 162/24

FOREIGN PATENT DOCUMENTS

45822/89 6/1990 Australia .
124193 3/1972 Norway .
WO88/03190 3/1988 PCT Int'l Appl. ..... 162/72

*Primary Examiner*—Steve Alvo
*Attorney, Agent, or Firm*—Steve T. Zelson; Elias J. Lambris

[57] ABSTRACT

Resin can be hydrolyzed enzymatically during the peroxy bleaching (e.g. with hydrogen peroxide) commonly used in pulp manufacture and the use of lipase in the manufacture of CTMP-fluff will afford several significant advantages, such as a pronounced reduction in fats, low time-consumption, since the process can be carried out in less than one calendar day, no losses in brightness or yield, or only marginal brightness and yield losses, and low handling costs. The enzyme treatment during bleaching necessitates little or no change of commonly used bleaching conditions. As a further advantage, the peroxy bleaching is mostly made at alkaline pH, whereby the liberated fatty acids remain ionized and can thus easily be removed from the pulp during subsequent washing.

13 Claims, 8 Drawing Sheets

HYDROLYSIS OF RESIN IN PULP WITH AN ENZYME AND A PEROXIDE

TECHNICAL FIELD

The present invention relates to hydrolysis of resin in pulp, particularly chemithermomechanical fluff-pulp for the manufacture of such sanitary articles as soft paper, tissue paper, disposable diapers etc.

BACKGROUND ART

It is known that some types of cellulose pulp made from wood have a high resin content, e.g. various types of mechanical pulp and pulp made by a sulphite process.

Mechanical pulping, alone or combined with a gentle chemical treatment, is widely used in the manufacture of pulps. Thus, chemithermomechanical pulps (CTMP) are produced by refining chemically pre-treated chips with yields of 85–95%. This chemical pre-treatment normally comprises impregnating the chips with an alkaline sulphite solution. The chips, thus impregnated with chemicals, are heated to temperatures above 100° C. and thereafter refined under pressure. The pulp is then normally screened and bleached. Bleaching is most often effected with hydrogen peroxide in an alkaline environment. One use for CTMP is found in the manufacture of sanitary articles, such as disposable diapers and similar absorption products. The processes used for producing mechanical pulp (such as CTMP) occur at pH in the range 4–9, and the components of the wood undergo relatively small chemical changes; the pulp therefore has a considerable content of resin.

The resin can create disturbances in the process of pulp manufacture and may also have a negative effect on the properties of the final pulp product. The ability of fluff-pulp to absorb aqueous liquids is of particular importance. The rate at which absorption takes place is also of particular significance. Since fat has a water-repelling nature, a high fat content will have a negative effect on the absorption rate. Further, agglomerated resin may cause paper breakage during paper manufacture or during printing.

Resin of wood material is soluble in organic solvents and, to a large extent, is comprised of hydrophobic components. It is known that the hydrophobic part of resin contains considerable amounts of triglycerides, more commonly known as fats, and other esters. The triglycerides play a large part in rendering the resin hydrophobic, therewith making it less possible to wash the resin from the pulp. It would be desirable to hydrolyse these as the hydrolysis products are more easily removed in aqueous systems.

Triglyceride hydrolysis can be achieved by treating the wood with a strongly alkaline liquid, similar to what takes place during sulphate cooking. Such alkaline conditions cannot be permitted in the manufacture of CTMP-pulp, however, because of discoloration, reduction in yield, etc. CTMP pulp therefore has a considerable content of triglycerides and esters from resin. It would be beneficial to find a catalyst other than alkali for the triglyceride hydrolysis process.

A low fat content can be obtained to some extent, by storing chips or roundwood. Thus, GB 1,189,604 and U.S. Pat. No 3,486,969 disclose a process for removing resin constituents from wood chips by applying microorganisms to wood chips during storage. This process, however, takes a relatively long time to carry out (at least one month) and is difficult to control, as temperature, residence time, microbial flora etc. may fluctuate. Furthermore, the storage of chips results in discoloration (darkening), and the microorganisms may secrete cellulase and hemicellulase that decreases fibre strength and yield.

The hydrolysis of wood-fat (triglycerides) during storage has been ascribed to fat-hydrolysing enzymes, i.e. lipases. (Anders Assarsson: "Hartsets förändring under vedlagring", Svensk Papperstidning published -72, pages 304–311).

It is an object of the invention to provide a controllable process for hydrolysing resin in pulp to form free acids which can be readily washed from the pulp. It is also an object to provide fluff-pulp having improved liquid absorbency, produced by such a process.

SUMMARY OF THE INVENTION

We have found that, surprisingly, resin can be hydrolyzed enzymatically during the peroxy bleaching (e.g. with hydrogen peroxide) commonly used in pulp manufacture and that the use of lipase in the manufacture of CTMP-fluff will afford several significant advantages, such as a pronounced reduction in fats, low time-consumption, since the process can be carried out in less than one calendar day, no losses in brightness or yield, or only marginal brightness and yield losses, and low handling costs. The enzyme treatment during peroxy bleaching necessitates little or no change of commonly used bleaching conditions. As a further advantage, the peroxy bleaching is mostly made at alkaline pH, whereby the liberated fatty acids remain ionized and can thus easily be removed from the pulp during subsequent washing. None of the aforesaid publications mentions, nor yet indicates, the possibility of using a lipase in the manufacture of CTMP-fluff.

Accordingly, the invention provides a process for hydrolysis of resin in pulp, characterized by carrying out enzymatic hydrolysis of resin simultaneously with peroxy bleaching of the pulp.

The invention also provides chemithermomechanical fluff-pulp (CTMP-fluff) for the manufacture of sanitary articles, such as soft paper, disposable diapers etc. having improved liquid absorbency, characterized in that the proportion of triglycerides in the pulp resin has been reduced by enzymatic hydrolysis of the triglycerides with the aid of a fat-cleaving enzyme, a lipase, such as to form free fatty acids which can be readily washed from the pulp, said lipase-treatment being carried out on either chips prior to pulp manufacture, during pulp bleaching or on bleached or unbleached CTMP at a temperature within the range of 20°– 80° C., preferably 30°–60° C., and at a pulp consistency of beneath 60% by weight and a pulp pH within the range of 3–12, preferably 7–10. The invention also provides a sanitary article in the form of soft paper, disposable diaper or the like, characterized in that said article has been produced from said fluff pulp.

Another aspect of the invention provides a method for manufacturing CTMP-fluff in accordance with the above characterized by adding to wet CTMP during pulp bleaching or on bleached or unbleached CTMP or to chips intended for a CTMP-process a fat-cleaving enzyme, a lipase, such as to degrade triglycerides present in resin, by enzymatic hydrolysis of said triglycerides to fatty acids capable of being readily washed from the pulp.

A further aspect of the invention provides use of a fat-cleaving lipase for the enzymatic degradation of resin in chemithermomechanical fluff-pulp (CTMP-fluff) by hydrolysis of the triglycerides present in the resin to fatty acids readily washable from the pulp, with the intention of improving the liquid absorbency of the fluff pulp when forming from said pulp such sanitary articles as soft paper, disposable diapers or the like, wherein the lipase is supplied to either wet CTMP-pulp or to chips intended for a CTMP-process, and wherein in that case where the lipase is added to the CTMP-pulp, said lipase preferably comprises a white-water preparation of the lipase having a temperature 20°–80° C., preferably 30°–60° C., such as to thin the pulp at a pulp pH lying within the range 3–12, preferably 7–10, and with a quantity of lipase corresponding up to 0.200 kg/tonne of pulp, preferably 0.05–0.15 kg/tonne of pulp of Resinase TM A (with lipase activity of 50 KLU/g), i.e. up to 10 KLU/kg, preferably 2.5–7.5 KLU/kg of pulp (KLU=1000 Lipase Units, defined in WO 89/04361).

BRIEF DESCRIPTION OF THE FIGURES

FIG. 2 shows the chip storing, chip washing, preheating and refining stages. FIG. 3 shows the screening, pulp screening and washing stages. FIG. 4 shows the bleaching and high concentration storing stages. FIG. 5 shows the flash drying, baling and sheet drying stages.

DETAILED DESCRIPTION OF THE INVENTION

Pulp

Figure 1:
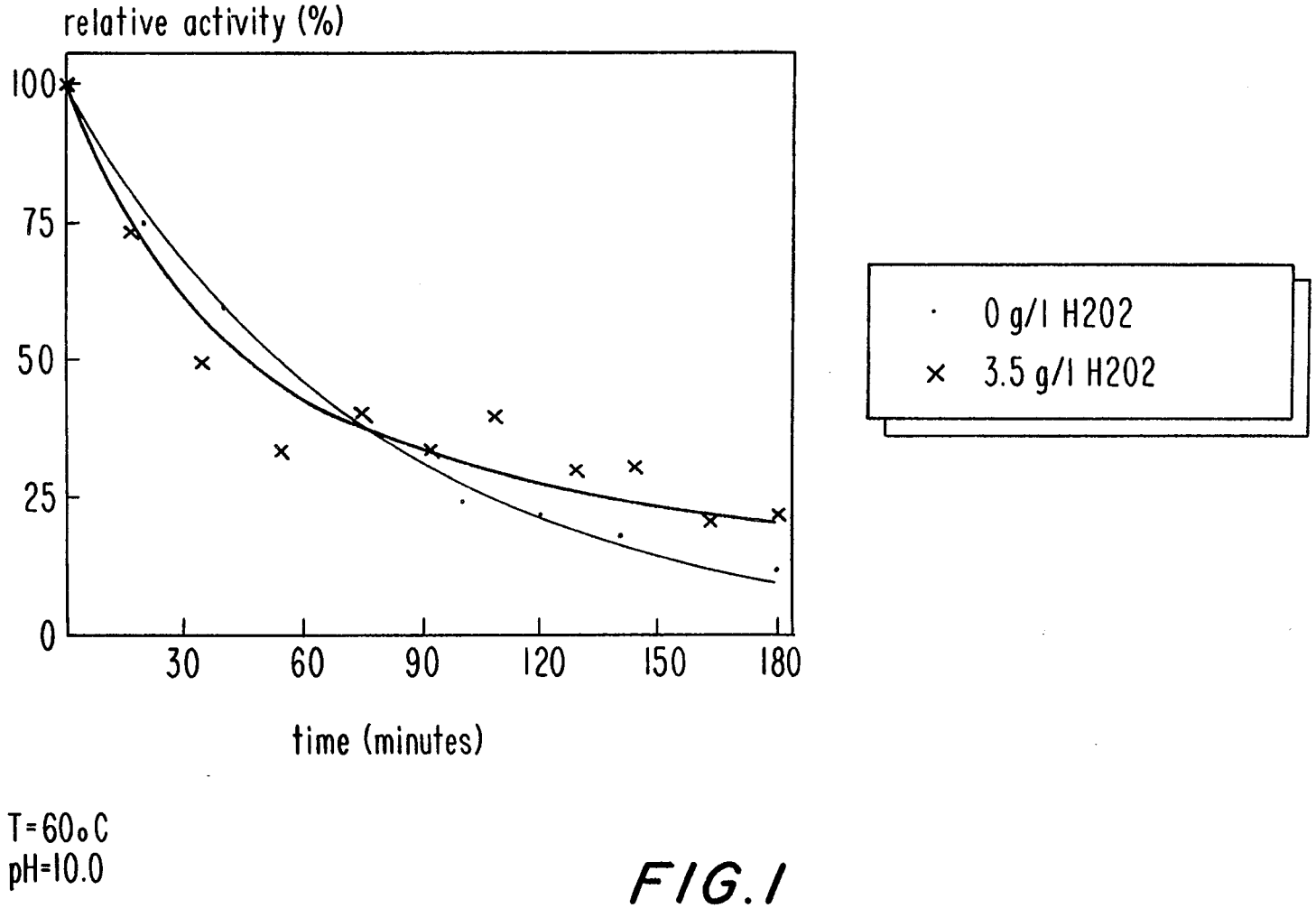
FIG. 1 shows the stability of lipase towards hydrogen peroxide.
Figure 2:
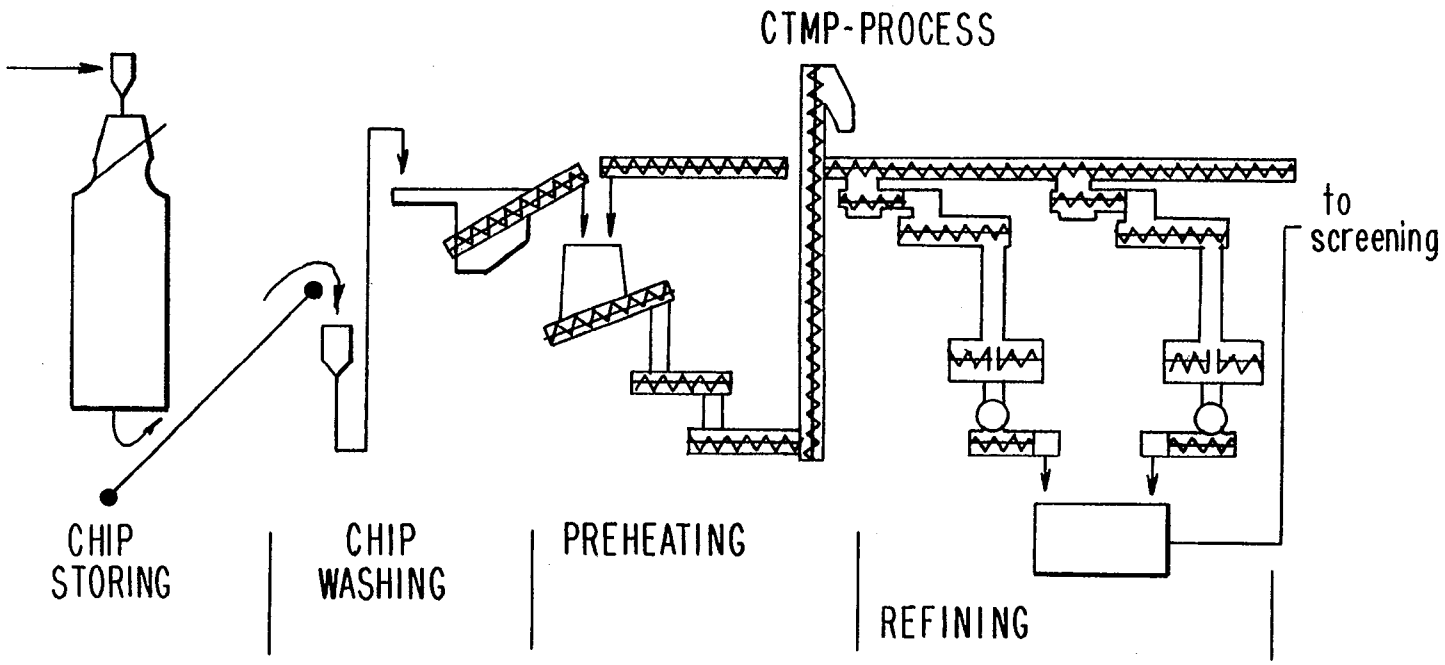
FIGS. 2–5 show a flow sheet for a CTMP (chemithermomechanical pulp) process.

Resin hydrolysis during peroxy bleaching according to the invention may be applied to any resin-containing pulp, especially to pulp with a considerable content of triglycerides and esters from resin. Examples are pulps produced by mechanical pulping, alone or combined With a gentle chemical treatment, such as GW (Ground Wood), TMP (Thermo Mechanical Pulp).and CTMP (Chemical Thermo Mechanical Pulp). Pulp produced by a sulphite process may also have a high resin content.

Enzyme

The invention uses an enzyme to hydrolyse the triglycerides and/or other esters in the resin, i.e. an enzyme with lipase and/or esterase (e.g. cholesterol esterase) activity. For obvious reasons, the enzyme to be used should be active and reasonably stable at the process conditions to be used; especially temperature, pH and the presence of peroxy bleaching agents affect the enzyme stability. More specifically, enzyme and process conditions are preferably chosen such that at least 10% of the enzyme activity remains after the reaction, and preferably more than 50% activity remains after 40 minutes.

Examples of suitable enzymes are lipases derived from strains of Pseudomonas (especially *Ps. cepacia, Ps. fluorescens, Ps. fragi* and *Ps. stutzeri*), Humicola (especially *H. brevispora*), Candida (especially *C. antarctica*), *H. ianuginosa, H. brevis var. thermoidea* and *H. insolens*), Chromobacterium (especially *C. viscosum*) and Aspergillus (especially *A. niger*). An example of a commercial preparation is Resinase TM A, product of Novo Nordisk A/S, with a lipase activity of 50 KLU/g.

The enzyme dosage required for significant resin hydrolysis depends on process conditions, but is generally above 0.1 KLU/kg of pulp dry matter, preferably 0.5–50 KLU/kg.

To avoid break-down of the fibre structure in the pulp, cellulase side-activities should be essentially absent, preferably below 1000 EGU/kg of pulp dry matter. Cellulase activity in EGU units is determined as follows:

A substrate solution is prepared, containing 34.0 g/l CMC (Hercules 7 LFD) in 0.1M phosphate buffer at pH 6.0. The enzyme sample to be analyzed is dissolved in the same buffer. 5 ml substrate solution and 0.15 ml enzyme solution are mixed and transferred to a vibration viscosimeter (e.g. MIVI 3000 from Sofraser, France), thermostated at 40° C. One Endo-Glucanase Unit (EGU) is defined as the amount of enzyme that reduces the viscosity to one half under these conditions. The amount of enzyme sample should be adjusted to provide 0.01–0.02 EGU/ml in the reaction mixture.

Peroxy bleaching

The resin hydrolysis process of the invention includes bleaching with a peroxy bleaching agent which may be hydrogen peroxide; a $H_2O_2$ adduct such as a perborate or percarbonate (e.g. as sodium salts); inorganic peracid or salt; or an organic mono- or di-peroxy peracid or salt thereof (e.g. peracetic acid). Hydrogen peroxide, commonly used for bleaching of pulp, is preferred.

The concentration of bleach is typically in the range 0.1–5% (by weight, calculated as $H_2O_2$ in % of pulp dry matter) throughout the reaction, preferably 0.25–2% at the start of reaction, decreasing to 0–0.4% after reaction.

Process conditions

Conventional conditions for pulp bleaching may be used for resin hydrolysis according to the invention. Typically, pH will be in the range 8.0–11.5 throughout the reaction, e.g. initial pH 10–11 and final pH 8.5–9.5.

Other additives commonly used in peroxy bleaching may be present, such as silicates, magnesium sulphate and sequestering agents (e.g. EDTA).

The bleaching temperature is usually 45°–75° C., especially 50°–60° C., and the reaction time will typically be in the range 0.5–5 hours.

The pulp will usually have a dry substance content of 5–30% (by weight), typically 10–20%.

Optional additional process steps

According to the invention, resin hydrolysis during peroxy bleaching is generally followed by draining of the bleach liquor and rinsing of the bleached pulp. Preferably, the pH is kept above 7.0 (most preferably above 8.0) during draining and rinsing in order to remove the hydrolysis products from resin.

Multi-step peroxy bleaching may be used in the invention. In this case, the enzyme may be added in the first step only or may be added to each step.

The peroxy bleaching according to the invention may be preceded by or followed by reductive bleaching, e.g. with sodium dithionite.

Manufacture of CTMP-fluff

Laboratory trials with enzyme treatment of recycled liquid in pulp manufacture (so-called white water) have shown that triglycerides can be cleaved to glycerol and free fatty acids with the aid of very small enzyme additions.

According to the invention, enzyme treatment for production of fluff pulp can be carried out during bleaching (as described above) or in a separate stage, either before or after the actual pulp manufacturing stage. Consequently, chip-treatment has been tested on both a laboratory and plant scale, and a partial triglyceride hydrolysis was obtained in both instances. Alternatively, unbleached or bleached pulp can be treated prior to drying the pulp. This treatment has been carried out during the trials in a manner which allowed the lipase to act on the pulp during its stay time in a storage tower prior to the drying process. The problem of combining optimum temperature with respect to the effect of lipase on the pulp with the conventional temperatures applied in the CTMP-process bas been solved in accordance with one preferred embodiment of the invention, by adding cold water to the pulp and therewith adjusting pulp temperature. Admittedly, this results in increased energy consumption during the subsequent drying process, although this problem has also been solved in accordance with the invention by thinning the pulp with hot water subsequent to treating said pulp with lipase, the temperature of said water being raised with the aid of steam prior to dewatering and continued treatment of the pulp in a manner known per se.

It will be obvious to one of normal skill in this art against the background of the investigations that have been carried out and which are described in the foregoing together with the results obtained, that although the trials have been directed to CTMP-pulp, the enzymatic triglyceride hydrolysis applied in accordance with the invention can be also be applied in the manufacture of thermo-mechanical fluff-pulp (TMP-fluff) which is a mechanical pulp produced with either a small or with no chemical addition, by defibrating chips preheated to 105°–130° C. The invention can also be applied in the manufacture of soft paper pulp, so-called tissue pulp, from either CTMP or TMP. Such pulp is used in the manufacture of basic paper for certain single-layer and multi-layer products, such as serviettes and toilet paper and other articles for sanitary use and domestic purposes. The invention may also be used in any other mechanical pulp production where hydrolysis and optionally subsequent removal of resin esters is of interest.

Quality of CTMP-fluff

The conversion of triglycerides to fatty acids according to the invention provides improved fluff properties. Laboratory trials show improvements in both absorption rate and network strength.

In those trials in which pulp was treated, marked differences were observed between the reference pulp and the enzyme-treated pulp. A pronounced difference was observed with respect to the important criterion absorption time in particular. The absorption time of the enzyme-treated pulp is thus shorter and would not appear to be dependent on pH, whereas the absorption time of the reference pulp was found to increase radically when the pH was lowered.

Enzyme-treated CTMP-fluff according to the invention obtained improved absorption-time values ("absorption time" is the time taken to wet a pulp pad (3 g) of specific shape and size in accordance with SCAN 33:80) and the absorption time is not equally as dependent on pH as a pulp which has not been treated with lipase. When manufacturing laboratory sheets it was found that in the case of a sheet produced from lipase-treated pulp the network strength had increased by about 1N. ("network strength" was determined by Applicant in accordance with an internal standard method and relates to the force, measured in N, required to rupture, i.e. press-through, a pad or cushion with the aid of a metal piston movable in a cylinder, said pad or cushion being formed from 1 g of dry-pulped fluff-pulp in a special pad former).

The pulp treated with lipase in accordance with the invention (Ex. 1) exhibited no increase in absorption time when the pH was lowered. The DCM-extract content (dichloromethane extract, determined in accordance with SCAN C7:62), however, did not appear to differ particularly from the reference pulp, at least not at the low pH-values. Consequently, it must be assumed that the changed composition of the resin is responsible for this effect. The resin present on the fibre surfaces should namely be free from triglycerides and should contain a high proportion of fatty acids. This would explain the difference in behaviour of the pulps, although it is still remarkable that the absorption time of the lipase-treated pulp is not increased to any appreciable extent when the pH is lowered.

The lipase-treated pulp has a greater specific volume. This greater specific volume will normally afford a longer absorption time and consequently the differences in absorption time cannot be explained by the differences in specific volume.

Compared with flash-dried pulp, the washing procedure employed causes the absorption time for all pulps to be relatively long. There should be no difference, however, between the reference pulp and the lipase-treated pulp.

One conclusion that can be drawn from the foregoing is that the resin composition has a marked effect on absorption time. The pulp can be given a favourable composition, by hydrolysing the triglycerides contained in the resin.

EXAMPLES

The invention is illustrated in the following on the basis of results obtained from trials and experiments carried out on a laboratory scale and on a full scale.

I. TRIALS ON A LABORATORY SCALE

Example 1

Treatment of bleached pulp on a laboratory scale

Figure 4:
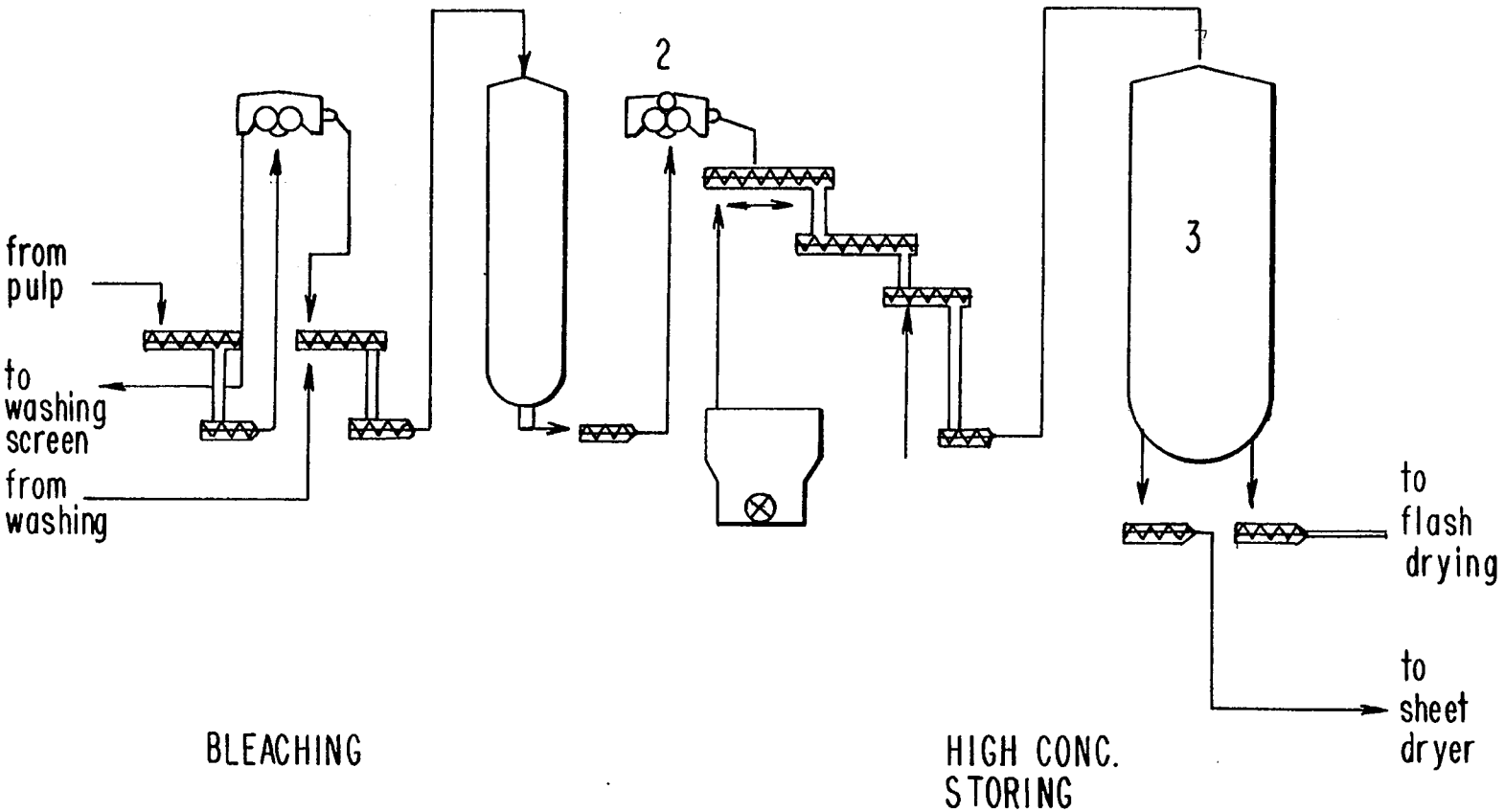
Figure 5:
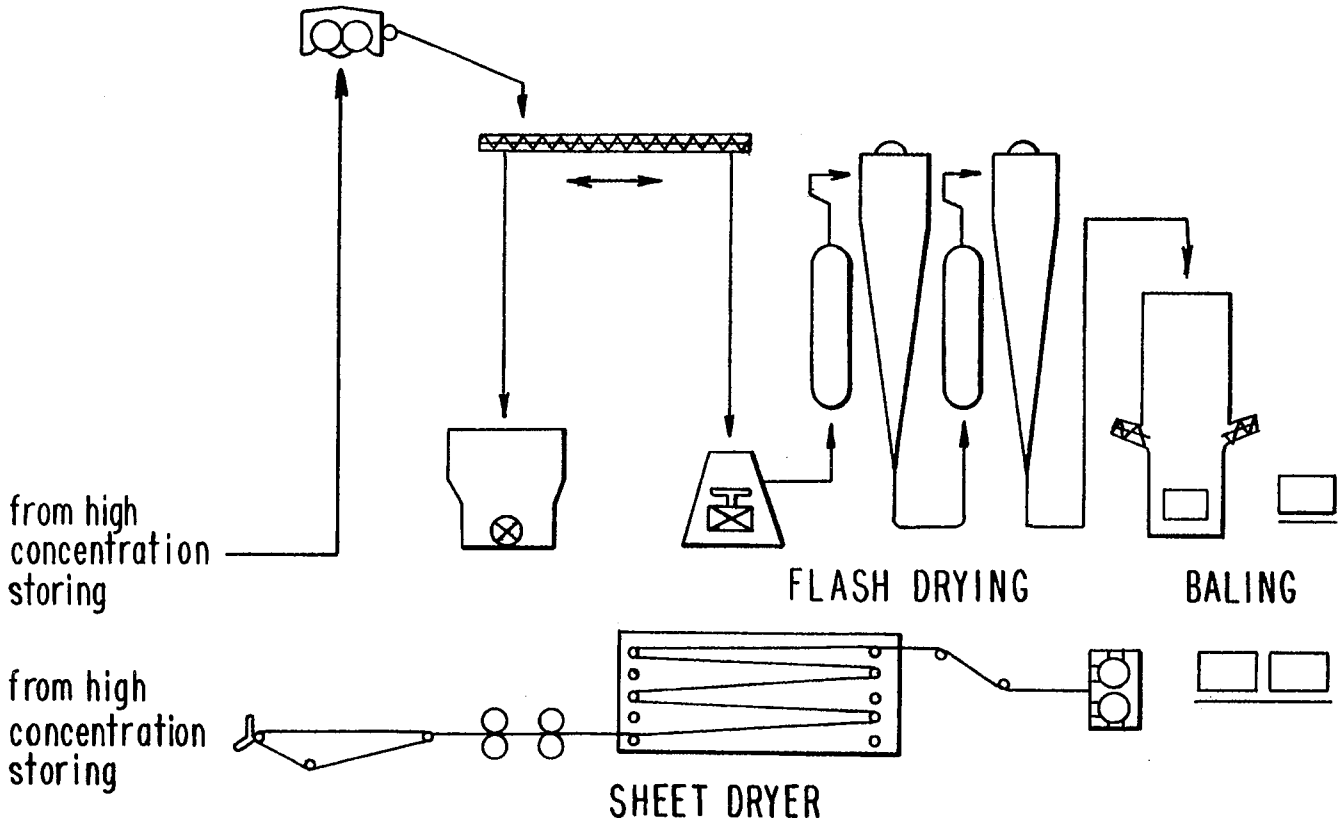

Pulp taken from a drainage press downstream of a bleaching stage (referenced 2 in the accompanying FIG. 4) was thinned with white water to a pulp-consistency of about 5%. The pulp suspension was divided into two parts, and an enzyme (Resinase TM A) was added to the one part in accordance with the invention. The enzyme addition was very high (5 ml/3 liters), so as to ensure that a full effect would be obtained. The two samples were kept in a heated cabinet, 40° C., for one calendar day, whereafter the samples were thinned with hot water and pulped (defibered). Sheets were then produced at mutually different pH-values in accordance with the network-strength-sheet method described above. The pH of the pulp was adjusted to pH-values of between 2 and 11, prior to and optionally subsequent to the wet-pulping process. This procedure provided many measuring points which improves the reliability of the process and which also illustrates the effect of the pH-value on the fluff properties. Subsequent to conditioning the sheets, the sheets were pulped in a Braun kitchen mixer for 30 seconds. The following results were obtained:

| pH before sheeting | Reference pulp | | | | | | | | Lipase-treated pulp | | | | | | | |
|---|---|---|---|---|---|---|---|---|---|---|---|---|---|---|---|---|
| | pH | Bulk | NVS | Vol. | Abs. time | Abs. cap. | Fract rest | DCM extr. | pH | Bulk | NSV | Vol. | Abs. time | Abs. cap. | Fract. rest | DCM extr. |
| 2 | 3.4 | 18.8 | 3.3 | 16.3 | 274.6 | 11.1 | | 0.47 | 3.4 | 20.2 | 4.7 | 16.6 | 12.4 | 11.2 | | 0.47 |
| 3 | 4.5 | 18.4 | 3.2 | 15.4 | 102.8 | 11.7 | | 0.36 | 4.7 | 19.6 | 4.6 | 16.6 | 11.6 | 10.9 | | 0.33 |
| 4 | 5.4 | 18.4 | 2.8 | 15.8 | 114.7 | 11.7 | | 0.36 | 5.6 | 19.6 | 4.1 | 17.0 | 12.1 | 11.2 | | 0.35 |
| 5 | 6.7 | 18.8 | 3.1 | 15.8 | 93.2 | 11.2 | | 0.32 | 6.4 | 19.6 | 3.9 | 16.9 | 10.6 | 11.0 | | 0.18 |
| 6 | 7.6 | 19.2 | 3.1 | 15.0 | 93.9 | 10.9 | | 0.32 | 7.7 | 18.8 | 3.6 | 16.9 | 8.9 | 11.0 | | 0.34 |
| 7 | 8.6 | 19.6 | 3.7 | 15.8 | 63.3 | 11.1 | | 0.26 | 8.6 | 19.6 | 4.0 | 16.9 | 10.6 | 11.0 | | 0.25 |
| 8 | 8.9 | 18.4 | 3.0 | 15.1 | 37.9 | 11.0 | 2.42 | 0.25 | 8.9 | 18.8 | 3.8 | 17.0 | 10.2 | 10.9 | 2.14 | 0.16 |
| 9 | 9.0 | 18.8 | 3.6 | 15.7 | 42.3 | 11.0 | 3.43 | 0.21 | 9.2 | 18.4 | 3.7 | 16.3 | 10.2 | 10.7 | 3.30 | 0.25 |
| 10 | 9.6 | 16.5 | 2.9 | 15.4 | 32.2 | 10.8 | | 0.30 | 9.8 | 19.6 | 4.3 | 16.3 | 9.9 | 10.8 | | 0.24 |
| 11 | 10.3 | 17.2 | 3.1 | 14.8 | 18.9 | 10.2 | | 0.33 | 10.2 | 19.2 | 4.2 | 16.3 | 5.9 | 10.4 | | 0.21 |

Prior to sheet manufacture the pH-values were between 2 and 11, but lay within a slightly lower range subsequent to drying and conditioning the sheets.

Bulk (inverted density value) and specific volume (volume through pulp) were not seen to vary with pulp-pH in a systematic fashion. A pronounced difference is found, on the other hand, between the lipase-treated pulp and the reference pulp. In the case of the reference pulp the mean value of bulk and specific volume is 18.4 and 15.5 $cm^3/g$ respectively, whereas the lipase-treated pulp had bulk and volume values of 19.3 and 16.7, respectively.

The lipase-treated pulp also had a higher network strength. The mean value of the lipase-treated pulp was 4.1N, whereas a corresponding value for the reference pulp was 3.2N. It was not possible to establish a clear relationship between network strength and pH.

The absorption time of the reference pulp is highly pH-dependent and increases radically when the pH is lowered. Lowering of the pH gives rise to two phenomena which are believed to impair the absorption rate. Firstly, a lower pH will result in the neutralization of charged groups, such as carboxylico-acid groups and sulphonic-acid groups, which results in a lower charge on the fibre surfaces. Secondly, a lower pH results in higher resin contents, since washing is also included in the manufacture of the sheets, which has an impaired function at lower pH-values.

The absorption time of the lipase-treated pulp does not have the same pH-dependency. Although the absorption time is admittedly lowest at pH 11, the differences between pH 2 and pH 10 are only marginal. The absorption time of the lipase-treated pulp is found to be clearly lower than the absorption time of the reference pulp in all instances. With regard to absorbency (the relationship between the weight of the water taken-up by a standard fluff-sample under determined conditions and the original weight of the sample, determined by weighing in conditioned air), only small variations were noted. It is possible that a high pH-value will result in a somewhat lower absorption capacity than will a low pH-value.

The generally high level of the DCM-extract contents is explained by the low dry-solids content obtained when manufacturing laboratory sheets.

The DCM-extract contents increase with decreasing pH-values, since the removal of resin by washing is impaired. No pronounced difference between the lipase-treated pulp and the reference pulp could be established at low pH-values. A certain tendency towards lower contents of the lipase-treated pulp were observed at high pH-values.

The fat content has been reduced by the enzymatic triglyceride hydrolysis, therewith imparting considerably improved absorption properties to the pulp. At a neutral pH-value, often used when web-drying pulp, the absorption time of the reference pulp is as much as ten times lower than the lipase-treated pulp. This difference is highly significant to the function of a disposable diaper, for instance.

The network-strength sheets used in the aforesaid trials shall have a surface weight (grammage) of 400 $g/m^2$ and were produced in the following manner:

A. Steeping

The pulp was shredded into pieces of about 20×20 mm in size. The pulp was steeped for 1 hour in a maximum of 2 liters of water at a temperature of about 20° C. The pulp quantity was adapted so that defibering (pulping) could be effected at a consistency of 0.8%.

B. Pulping

The pulp was defibered in a wet pulper (cold defibration) at a speed of 20 000 rpm and in a liquid-volume of 2 liters.

The wet pulper was of the kind specified in SCAN-C 18:65.

C. Sampling

The suspension was stirred and divided into 4×500 ml portions.

D. Sheet manufacture

Sheets were produced in a Büchner-funnel with a monodure fabric placed on the bottom thereof. The fabric was moistened with water and the vacuum-tap opened slightly. Pulp suspension (500 ml) was then poured into the funnel. The vacuum-tap was opened still further and water sucked-off, during which efforts were made to avoid air being sucked through the pulp cake. The white water was recycled once and the water again sucked-off.

The pulp cake was loosened and the monodure fabric removed. The cake was placed on a filter paper and covered with a further filter paper. No press pressure was exerted.

E. Drying

The samples (wet) were hung-up in a climatic room (50% RH, 23° C.) and allowed to dry over a period of at least one calendar day.

F. Determining network strength

The samples were pulped in a climatic chamber (50% RH, 23° C.) in a Braun Multimix 30 S at a rate of 1 and 3–3.5 g pulp per pulping process. The pulp was conditioned for at least four hours prior to determining the network strength in the manner described above.

Testing the liquid dispersion ability of lipase-treated pulp

The relationship between absorption time (vertical liquid transport; the time taken to saturate completely a standard fluff test-piece with absorbed water when sampling under given conditions) and dispersement (horizontal liquid transport) was tested for enzyme-treated pulps and non-treated pulps.

In this instance, the pulps were prepared in a manner slightly different to the manner described above. Pulp from a drainage press was thinned to 3% with white water and wet-pulped or defibrated. The pulp suspension was divided into two parts, one of which was supplied with lipase (2.5 ml/kg absolute dry pulp). The samples or test-pieces were then maintained at a temperature of 40° C. for 1 calendar day. The pH of the pulp was then adjusted and sheets were produced on a sheet former (about 20 g/sheet). Subsequent to drying and conditioning the sheets, the sheets were dry-pulped in a laboratory mill and sample bodies were formed. These were then tested with a dispersement meter, by means of which the propagation of liquid in a fluff sample-body was measured.

The trials were carried out at pH values 2 (solely reference pulp), 7 and 11. It was found that the enzyme-treated pulp had a different dispersement picture to the reference pulp. The liquid had dispersed over a larger area in the enzyme-treated pulp. It was also found that the dispersement of liquid was better in a pulp having a higher pH-value. The rewetting values point in the same direction: ("rewetting" is the amount of liquid in g which can be sucked-up, in a given specified manner, from the surface of the sample body with the aid of filter paper after a given period of time).

| | Rewetting (g) | |
|---|---|---|
| pH | Reference pulp | Enzyme-treated pulp |
| 2 | 35.9 | — |
| 7 | 34.6 | 27.8 |
| 11 | 29.9 | 25.6 |

The enzyme-treatment apparently also has a positive effect on liquid-dispersing properties.

Example 2

Chip treatment on a laboratory scale

An important advantage would be afforded if it were possible to hydrolyse triglycerides in the actual chips themselves. For instance, the resin present in the chips would be converted prior to pulp manufacture, which would facilitate washing-out the resin. Furthermore, there is greater freedom in temperature selection when treating chips in this manner than when treating pulp.

Chips were treated with enzyme (Resinase TM A) on a laboratory scale, by spraying with and through-leaching in water containing the enzyme.

1 kg of chips (about 400 g wood) was sprayed with 2 dl water+enzyme and leached respectively in 2.5 liter of water+enzyme. The enzyme was added in quantities of 0.01; 0.1 and 1.0 ml or 0.5; 5 and 50 KLU.

The chips were maintained at a temperature of 40° C. for 1 calendar day and then frozen. A reference sample to which no liquid was supplied was also maintained at a temperature of 40° C. for 1 calendar day and then frozen. Characterization of the resin-content of the chip-samples gave the following results:

| Sample | Reference sample | Sprayed chips | | | Leached chips | | |
|---|---|---|---|---|---|---|---|
| Enzyme add. ml/kg | 0 | 0.01 | 0.1 | 1.0 | 0.01 | 0.1 | 1.0 |
| EtOH-extr. | 2.55 | 2.06 | 2.25 | 2.21 | 2.32 | 2.22 | 1.86 |
| DCM-extr. | 1.85 | 1.45 | 1.57 | 1.58 | 1.63 | 1.60 | 1.26 |
| Triglycerides | 0.18 | 0.06 | 0.07 | 0.05 | 0.10 | 0.08 | 0.02 |
| Steryl-esters | 0.20 | 0.12 | 0.10 | 0.14 | 0.13 | 0.11 | 0.06 |
| Resin-acids | 0.22 | 0.15 | 0.19 | 0.16 | 0.27 | 0.30 | 0.16 |
| Remainder % | 1.25 | 1.12 | 1.21 | 1.23 | 1.13 | 1.11 | 1.02 |

It was not possible to determine the fatty-acid contents during the analysis, due to a disturbing compound which caused the peak of the fatty acid to be partially hidden in the chromatogram. Probably monoglycerides had formed as a result of incomplete hydrolysis. However, it was possible to follow the triglyceride hydrolysis, by studying the residual quantity of triglycerides.

The proportion of triglycerides in the reference sample was low, from which the conclusion can be drawn that the chips were not particularly fresh.

The sprayed chips had a pronouncedly lower triglyceride content than the reference sample, clearly showing that the enzyme had been effective. The difference between the various enzyme dosages is very small, however, which is remarkable in view of the fact that the largest addition is 100 times greater than the smallest. This could possibly be because certain regions of the chips were not accessible to the liquid, thereby preventing hydrolysis of the triglycerides. In other regions reached by the liquid, hydrolysis of the triglycerides was observed to have taken place even with low enzyme additions.

The leached chip-samples have obtained lower triglyceride contents at higher enzyme additions. In this treatment, the chip pieces were allowed to "swim" in a weak enzyme solution and it can be assumed that impregnation of the wood was more thorough than when spraying the wood. However, the enzyme concentration was lower, due to the greater volume of liquid. This improved impregnation can explain why it was possible to obtain a lower triglyceride content at the highest enzyme addition, as compared with spraying. This greater degree of dilution, however, has required the use of larger quantities of enzyme. A not inconsiderable reduction in extract content is also obtained at the highest enzyme dosage. This is possibly because resin has been unable to diffuse out in the liquid.

In order to guarantee the aforesaid result, the spraying process was repeated on fresher or greener chips. The effect of slightly lower enzyme dosages was also tested in this trial. In this trial, the samples were not frozen, but were sent immediately for analysis. Unfortunately, there was an interim period of about 15 hours before the analysis was carried out. Thus, the time period prior to triglyceride hydrolysis comprised 24 hours at 40° C.+15 hours at room temperature.

| Sample | Reference sample | Sprayed chips | | | | |
|---|---|---|---|---|---|---|
| Enzyme-add.ml/kg | 0 | 0.005 | 0.01 | 0.05 | 0.10 | 0.50 |
| EtOH extract % | 2.35 | 2.85 | 2.83 | 2.34 | 2.13 | 2.43 |
| DCM-extract % | 1.42 | 1.83 | 1.64 | 1.38 | 1.32 | 1.51 |
| Triglyce-rides % | 0.38 | 0.42 | 0.39 | 0.30 | 0.10 | 0.12 |
| Fatty acids % | 0.14 | 0.42 | 0.38 | 0.28 | 0.29 | 0.18 |
| Steryle-esters % | 0.16 | 0.22 | 0.25 | 0.21 | 0.21 | 0.14 |
| Resin-acids % | 0.10 | 0.22 | 0.31 | 0.18 | 0.17 | 0.09 |
| Remainder % | 0.64 | 0.55 | 0.31 | 0.41 | 0.47 | 0.98 |

Since both the proportion of "remainder" and the DCM-extract content has varied pronouncedly, it is appropriate to study solely the triglyceride content. In order to obtain information about the extent of the triglyceride hydrolysis, it is necessary to consider the relationship between triglycerides and fatty acids. The ratio of triglycerides to fatty acids is markedly lower for the lipase-treated samples. A major part of the triglyceride hydrolysis has taken place at the lowest enzyme dosage also in this test, whereas increased dosages do not result in any marked increase in effect. This strengthens the assumption that not all of the resin can be reached by the liquid when spraying chips.

Example 3

White water treatment on a laboratory scale

Figure 3:
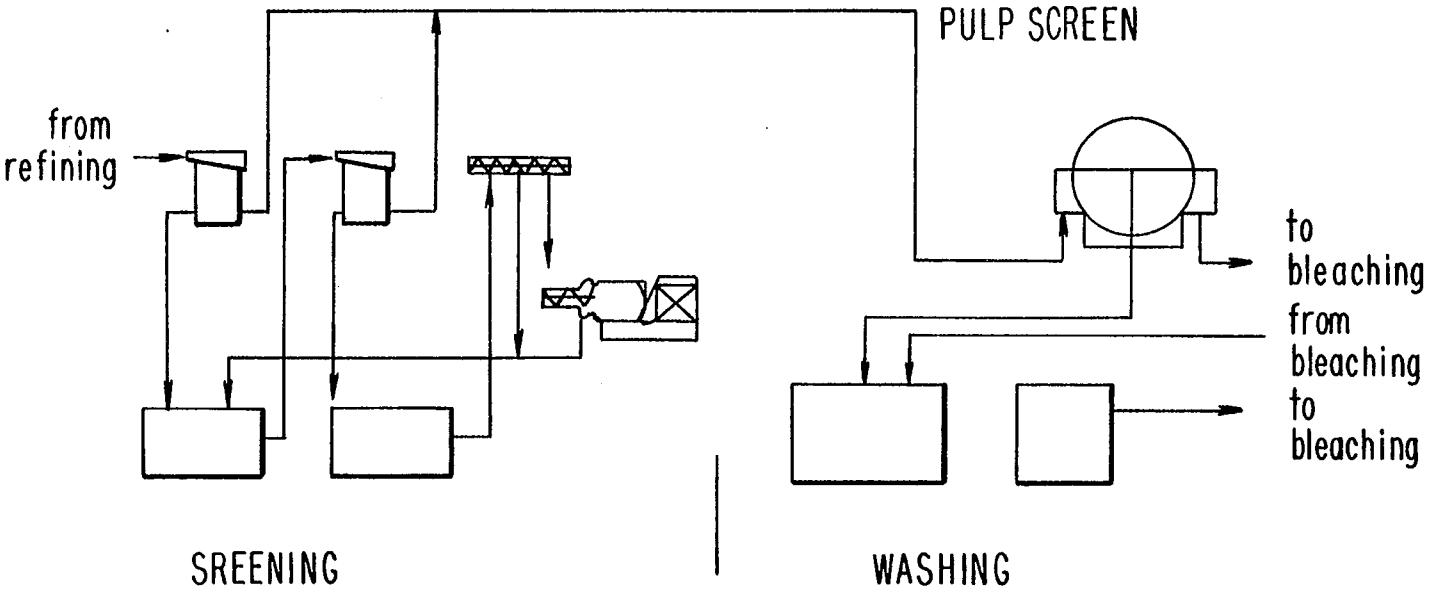

White water obtained from a pulp filter upstream of the bleaching stage (1 in the accompanying FIG. 3) was treated with lipase (Resinase TM A) on a laboratory scale. The enzyme was introduced into the liquid, which was then maintained at a temperature of 40° C. for 24 hours. The samples were then cooked in order to destroy the enzyme, and therewith stop the reaction. Resin characterization was then carried out.

White-water treatment was carried out in two stages. The liquid had a pH of 8 in the first treatment stage and up to 250 KLU per liter of white water were added. The following result was obtained:

| Enzyme addition | | Triglyce-rides % | Fatty acids % | Steryle esters % | Resin-acids % |
|---|---|---|---|---|---|
| Untreated | | 25 | 4 | 21 | 50 |
| 5 KLU/L | 0.1 ml/l | 2 | 48 | 15 | 35 |
| 25 KLU/L | 0.5 ml/l | 2 | 48 | 17 | 33 |
| 50 KLU/L | 1 ml/ml | 1 | 50 | 14 | 35 |
| 250 KLU/L | 5 ml/l | 1 | 57 | 13 | 29 |

It will be seen that the major part of the triglycerides had hydrolyzed at the lowest enzyme dosage. The test was therefore repeated at lower enzyme dosages. During this treatment process, the pH was 7.5. The following result was obtained:

| Enzyme addition | | Triglyce-rides % | Fatty acids % | Steryle esters % | Resin-acids % |
|---|---|---|---|---|---|
| Untreated | | 24 | 16 | 18 | 24 |
| 0.01 KLU/L | 0.2 ml/m$^3$ | 7 | 50 | 18 | 25 |
| 0.05 KLU/L | 1.0 ml/m$^3$ | 6 | 51 | 18 | 25 |

-continued

| Enzyme addition | | Triglyce-rides % | Fatty acids % | Steryle esters % | Resin-acids % |
|---|---|---|---|---|---|
| 0.10 KLU/L | 2.0 ml/m$^3$ | 2 | 52 | 20 | 26 |
| 0.50 KLU/L | 10.0 ml/m$^3$ | 0 | 52 | 22 | 26 |
| 1.00 KLU/L | 20.0 ml/m$^3$ | 0 | 55 | 21 | 24 |
| 2.00 KLU/L | 40.0 ml/m$^3$ | 0 | 57 | 19 | 24 |
| 5.00 KLU/L | 100.0 ml/m$^3$ | 0 | 48 | 29 | 23 |

The major part of the triglycerides had been hydrolysed even at these much lower enzyme additions. Residual quantities of triglycerides remain at the absolute lowest additions, however. This enables an estimate to be made of the enzyme addition required. This requirement is believed to be 0.1–0.5 KLU/liter white water in order to obtain complete triglyceride hydrolysis by treating at 40° C. for 1 calendar day.

It should be noted that the enzyme is not consumed by the reaction, but merely catalyses the cleaving of the triglycerides. Consequently, the requisite enzyme addition is lower when recycling white water. Enzyme activity is lowered, however, when the enzyme is subjected to high temperatures.

Example 4

The stability of a commercial lipase product at bleaching conditions was tested as follows.

An aqueous solution of 5.2 g/l sodium silicate (38 Be) and 3.5 g/l hydrogen peroxide (100%) was adjusted to pH=10.0 using sodium hydroxide. To this solution a commercial liquid lipase formulation (Resinase TM A, product of Novo Nordisk A/S) was added.

The lipase activity in the solution was measured during the next three hours. Relative activities are shown in FIG. 1. The relative activity is defined as the activity at a given time in percent of the initial lipase activity. The absolute activities have been measured in KLU-units.

The results show that the lipase is fairly stable towards hydrogen peroxide. The performance of the lipase over three hours, which is measured as the area under the curves plotted in FIG. 1, is only decreased by 14.5% by the addition of 3.5 g/l hydrogen peroxide compared to no addition of peroxide.

The results are shown in FIG. 1. It is seen that the enzyme is fairly stable at these typical bleaching conditions, with a half-life above 60 minutes, and about 15% of the enzyme activity remaining after a typical reaction time of 3 hours.

II. FULL SCALE TRIALS

The results obtained from the laboratory trials indicated that the absorption rate was improved by the lipase treatment. Furthermore, the absorption rate was less sensitive to the pH-value. The network strength was also found to be affected positively by the lipase treatment. It was found that these results called for trials on a larger scale. In order for such trials to be successful, however, it was necessary to be able to lower the temperature of the pulp to values acceptable to the lipase, and to subsequently store the pulp for a given period of time. The only location in the process where the pulp is stored over a longer time period is the storage tower 3 upstream of the flash dryer stage. The pulp is here stored at a consistency of 12% and constitutes a buffer between the CTMP-mill and the drying unit. The pulp is drained or dewatered downstream of the storage tower, on a roll press, and then passes to the flash dryer.

It is adjudged possible to lower the temperature of the pulp in the storage tower without disturbing the process to any great extent. However, a low temperature at this location of the process chain will decrease maximum production of the downstream roller press and result in higher energy consumption in the flash-drying stage. Consequently, process control was adapted in accordance with the following example:

Example 5

Trial set-up

In the case of the process equipment available, the most suitable location for lipase-treatment of the pulp was the storage tower (reference numeral 3 in the accompanying FIG. 4) for drying purposes. The following conditions were found to be significant in enabling the lipase to have good effect: 1) good admixture of the lipase, 2) a maximum temperature of about 50° C., 3) long stay time in the tower (up to one calendar day).

The pulp was thinned in a mixer upstream of the tower from a pulp consistency of 50% to a pulp consistency of 12%, with white water taken from a drainage press. The lipase (Resinase TM A) was introduced in the pulp-thinning water, so as to ensure good admixture. The addition of cold water at the same location, lowered the temperature to 50° C., which is one condition for achieving the best lipase-effect, as mentioned above. The pulp was thinned downstream of the tower with hot water taken from the white water system, as is conventional. The temperature of the white water was increased to about 90° C. with the aid of steam, so as to obtain the highest possible temperature prior to the dewatering process.

The trial included pulp production over about three calendar days. The analysis of bale pulp was intensified during these calendar days and a previous reference period. Resin-characterization of the pulps from the roller presses was also carried out upstream of and downstream of the tower. These pulps were frozen immediately after sampling. Pulp exiting from the tower was pressed in a potato press and the water expelled was recovered. Resin characterization was effected subsequent to boiling and freezing the samples.

During the first calendar day of the trial, the lipase charge was about 0.2 kg for each tonne of pulp. The charge was then lowered to about 0.1 kg/tonne. The resin of the white water shall have converted after a given time period, therewith requiring less lipase. This was the reason for changing the dosage.

The level in the tower should have been 20–25 m, but was initially only 10 m, due to a temporary production problem in the CTMP-plant. The level was then raised and was about 20 m during the latter part of the trial. This means that the tower stay-time was increased from about 10 to 20 hours.

Result

Resin characterization

Resin characterization was carried out on pulps from the roller presses upstream and downstream of the tower. These pulps were frozen immediately after sampling. Pulp exiting from the tower was pressed in a potato press and the expelled water recovered. Resin characterization was effected subsequent to cooking and freezing. The following values were obtained:

| | Time | DCM % | Triglycerides mg/kg | Steryl-esters mg/kg | Fatty acids mg/kg | Resin-acids mg/kg |
|---|---|---|---|---|---|---|
| Input pulp | 07-26 15:37 | 0.12 | 108 | 91 | 50 | 61 |
| | 0:200 | 0.08 | 28 | 59 | 37 | 34 |
| | 07-27 10:00 | 0.08 | 88 | 99 | 41 | 45 |
| | 18:04 | 0.08 | 104 | 116 | 23 | 42 |
| | 07-28 07:20 | 0.09 | 88 | 91 | 45 | 47 |
| Output pulp reference | 07-26 10:50 | 0.08 | 56 | 72 | 28 | 43 |
| | 15:35 | 0.08 | 49 | 72 | 21 | 44 |
| | 19:30 | 0.09 | 63 | 80 | 31 | 48 |
| Output pulp: sample | 07-27 07:00 | 0.07 | 26 | 67 | 32 | 45 |
| | 18:07 | 0.08 | 13 | 65 | 37 | 42 |
| | 02:00 | 0.11 | 77 | 103 | 37 | 52 |
| | 07-28 09:10 | 0.09 | 19 | 63 | 25 | 46 |
| | 19:15 | 0.08 | 19 | 68 | 40 | 47 |
| Water pressed-out reference pulp | 07-26 10:40 | 113 | 6 | 5 | 2 | 29 |
| | 15:45 | 69 | 4 | 4 | <1 | 18 |
| | 19:38 | 78 | 6 | 5 | 1 | 16 |
| Water pressed-out; sample pulp | 07-27 07:00 | 48 | 1 | 3 | 1 | 13 |
| | 18:20 | 52 | 2 | 2 | 1 | 12 |
| | 02:00 | 51 | 1 | 3 | 1 | 11 |
| | 07-28 09:00 | 61 | 1 | 3 | 1 | 11 |
| | 20:02 | 62 | 2 | 3 | 1 | 15 |

As already mentioned, triglycerides are degraded in the triglyceride hydrolysis, therewith forming free fatty acids. The quotient between trilycerides and fatty acids should thus well reflect the result of the reaction:

| | Time | | Ratio triglycerides/fatty acids | |
|---|---|---|---|---|
| Input pulp | 07-26 | 15:37 | 2.16 | Mean value: 2.31 |
| | | 0:200 | 0.76 | |
| | 07-27 | 10:00 | 2.14 | |
| | | 18:04 | 4.52 | |
| | 07-28 | 07:20 | 1.95 | |
| Output pulp reference | 07-26 | 10:50 | 2.00 | Mean value: 2.12 |
| | | 15:35 | 2.33 | |
| | 07-26 | 19:30 | 2.03 | |
| Output pulp sample | 07-27 | 07:00 | 0.81 | Mean value: 0.90 |
| | | 18:07 | 0.35 | (0.60 when excluding the |
| | | 02:00 | (2.08) | uneven value 2.08) |
| | 07-28 | 09:10 | 0.76 | |
| | | 19:15 | 0.48 | |
| Water pressed-out, reference | 07-26 | 10:40 | 3.00 | Mean value: >4.3 |
| | | 15:45 | >4 | |
| | | 19:38 | 6.00 | |
| water pressed out, sample | 07-27 | 07:00 | 1.00 | Mean value: 1.50 |
| | | 18:20 | 2.00 | |
| | | 02:00 | 1.00 | |
| | 07-28 | 09:00 | 2.00 | |

It will be seen that the input pulp ratio varies between 0.76 and 4.52 din the samples taken. This is possibly due to variations in the chip storage state. In such cases pulp having the ratio 0.76 has been produced from chips which have been stack-stored over a longer period than the pulp having the ratio 4.52. The mean value of the five samples was 2.31, which indicates that the chips used at the time of the trial have been relatively well stored. The ratio of triglycerides to fatty acids may be in excess of 15 in the case of fresh, spruce sawmill chips.

During the reference period, the outgoing pulp had an mean quotient of 2.12, which did not differ appreciably from the quotient of the ingoing pulp. This showed that storage of the pulp alone had no influence on the relationship between triglycerides and fatty acids. The pulp had a pH of 9 and at this pH value the rate at which the natural triglyceride-hydrolysis reaction takes place is too slow for a storage time of 20 hours to have any great effect.

During the trial or experimental period, the quotient between triglycerides and fatty acids fell to markedly lower values than during the earlier reference period. This shows that triglyceride hydrolysis had taken place. The mean value of the quotient was 0.90 during the trial period. One of the values, however, deviated radically and lay at the same level as the ingoing pulp (2.08). The pulp concerned in this particular case may not have received an addition of lipase, for some reason or other. It is also possible that the lipase had not been properly admixed with the pulp in question or perhaps there had been a short interruption in metering of the lipase to the pulp. If this deviating value is ignored, the mean value is 0.60.

The water pressed from the pulp exhibited very low contents of both triglycerides and fatty acids. A clear reduction in triglyceride content can be seen during the trial period.

The absorption properties of the final pulp was tested in accordance with SCAN-C 33:80. This test also showed a marked reduction in the absorption time. The absorption time during the trial or test period and during a preceding reference period are shown below. The absorption time, which was measured on 18 different pulp samples, is the time taken to saturate completely a standard fluff sample with absorbed water when testing under conditions stated in the aforesaid standard.

| Reference time Abs. time (s) | Trial period Abs. time (s) |
|---|---|
| 9.9 | 5.8 |
| 8.0 | 5.8 |
| 6.5 | 7.0 |
| 6.0 | 5.5 |
| 8.8 | 6.7 |
| 7.1 | 5.4 |
| 9.7 | 6.0 |
| 6.0 | 5.9 |
| 8.3 | 5.4 |
| 5.8 | 6.0 |
| 6.4 | 6.8 |
| 6.1 | 5.6 |
| 10.3 | 6.0 |
| 9.7 | 5.9 |
| 6.9 | 5.6 |
| 6.8 | 5.7 |
| 9.9 | 5.8 |
| 5.8 | 6.2 |
| Mean values: | |
| 7.7 sec | 5.9 sec |

It will be seen that the mean value for the reference period is 7.7 s, whereas corresponding values for the trial period is 5.9 seconds, which indicates that an improvement of about 24% was achieved when practising the invention. These values cannot be compared directly with the values from Example 3, which derive from pulp sheets produced in the laboratory.

As a result of the enzymatic hydrolysis to which the pulp is subjected, the fat content of the pulp is reduced, therewith rendering the pulp more hydrophilic. The pulp is thus able to absorb aqueous liquids more rapidly and will consequently have an improved function in disposable diapers and other absorption products for example.

A discussion of the results of the trial

The absorption time is lowered from an mean value of 7.7 s during the reference period to an mean period of 5.9 s during the trial period. Wide variations in absorption time were experienced during the reference period. The values were more uniform and on a lower level during the trial period. This is in agreement with the laboratory tests carried out earlier.

The wetting time, measured on aged pulp, also exhibited improved values during the trial period. The three trial days had the lowest mean values of the month with respect to the wetting time of aged pulp. ("Wetting time" is measured on pulp which has been aged at 105° C. for 2 hours in a heated cabinet, and is the time required for a pulp pad (3 g) to sink in water.)

No lowering of the DCM-extract content of the bale pulp was noted. Neither could any lowering of the extract content be expected, since the treatment was effected in the last stage of the process and the pulp had not yet been subjected to effective washing subsequent to the lipase treatment process.

The experiment, or trial, was carried out during the summer months, and the chips used were therefore relatively well stored. As mentioned above, the hydrolysis of triglycerides is an important reaction which takes place in the wood over the storage period, and consequently lipase-treatment on pulp manufactured from stored chips will have no particular effect on the pulp. When fresher chips are used, pulp produced in accordance with known process techniques will have a higher resin content and a major part of the resin will consist of triglycerides. Lipase-treatment will have a greater effect on the fluff properties under such conditions.

Variations in the absorption rate and the network strength of the pulp were observed during the period covering January-February 1989. Resin characterization was effected on four pulps of mutually different properties.

| | 11.1.1989 9:30 a.m. | 23.12.1989 1:30 a.m. | 4.2.1989 9:30 a.m. | 11.2.1989 9:30 a.m. |
|---|---|---|---|---|
| Abs. time (s) | 7.2 | 7.2 | 10.6 | 10.3 |
| Abs. cap(g/g) | 9.7 | 9.7 | 9.7 | 9.6 |
| Volume (cm/g) | 13.8 | 14.0 | 13.1 | 12.8 |
| NVS (n) | 3.2 | 3.7 | 2.9 | 2.9 |
| Wetting time aged (s) | 5 | 8 | 12 | 10 |
| DCM-extr.(%) | 0.14 | 0.13 | 0.16 | 0.15 |
| Triglycerides (mg/kg) | 419 | 359 | 603 | 435 |
| Resin acids (mg/kg) | 65.1 | 55.6 | 47.9 | 32.0 |
| Steryl esters (mg/kg) | 184 | 162 | 203 | 147 |
| Fatty acids (mg/kg) | 164 | 156 | 107 | 94.1 |
| Triglycerides/ fatty acids quotient | 2.55 | 2.33 | 5.64 | 4.62 |

It will be seen that a clear relationship is found between the fluff properties and the resin composition. When the quotient between triglycerides and fatty acids is high, the properties of the pulp are worse, both with respect to absorption and to network strength.

If good fluff properties are contingent on low triglyceride contents, then enzymatic triglyceride hydrolysis is one way of improving pulp quality and eliminating seasonal variations. This investigation indicates that such is the case with regard to absorption rate.

Example 6

This Example is concerned with the lipase-treatment of chips prior to pulp manufacture. Chips were sprayed with a diluted lipase (Resinase TM A) solution in trials carried out in the mill. The chips were then maintained at a temperature of 40° C. for a period of about 1 calendar day before being used for pulp manufacture. The enzyme charge was 0.2 kg for each tonne of chips. The dry content of the chips was about 40%, and consequently the lipase charge was about 0.5 kg/tonne calculated on absolute dryness. The course followed by the hydrolysis can be studied by characterizing the chip resin and comparing the quotient between triglycerides and fatty acids. The following results were obtained: Triglyceride/fatty acid quotient

| Untreated chips | Lipase-sprayed chips |
|---|---|
| 2.34 | 1.07 |
| 1.66 | 0.61 |
| 3.90 | 1.00 |
| | 0.70 |
| | 0.40 |
| Mean value 2.63 | Mean value 0.76 |

Since the quotient between triglycerides and fatty acids has decreased, a triglyceride hydrolysis has taken place. This shows that the treatment of chips also provides the result desired.

Example 7

Simultaneous lipase treatment and peroxide bleaching of CTMP pulp (plant trial)

A plant scale trial on the combined lipase treatment and peroxide bleaching of CTMP pulp was performed. The pulp used for the experiments was produced from fresh softwood chips which had been frozen. This type of pulp is known to cause resin troubles with regard to water absorption properties.

Figure 6:
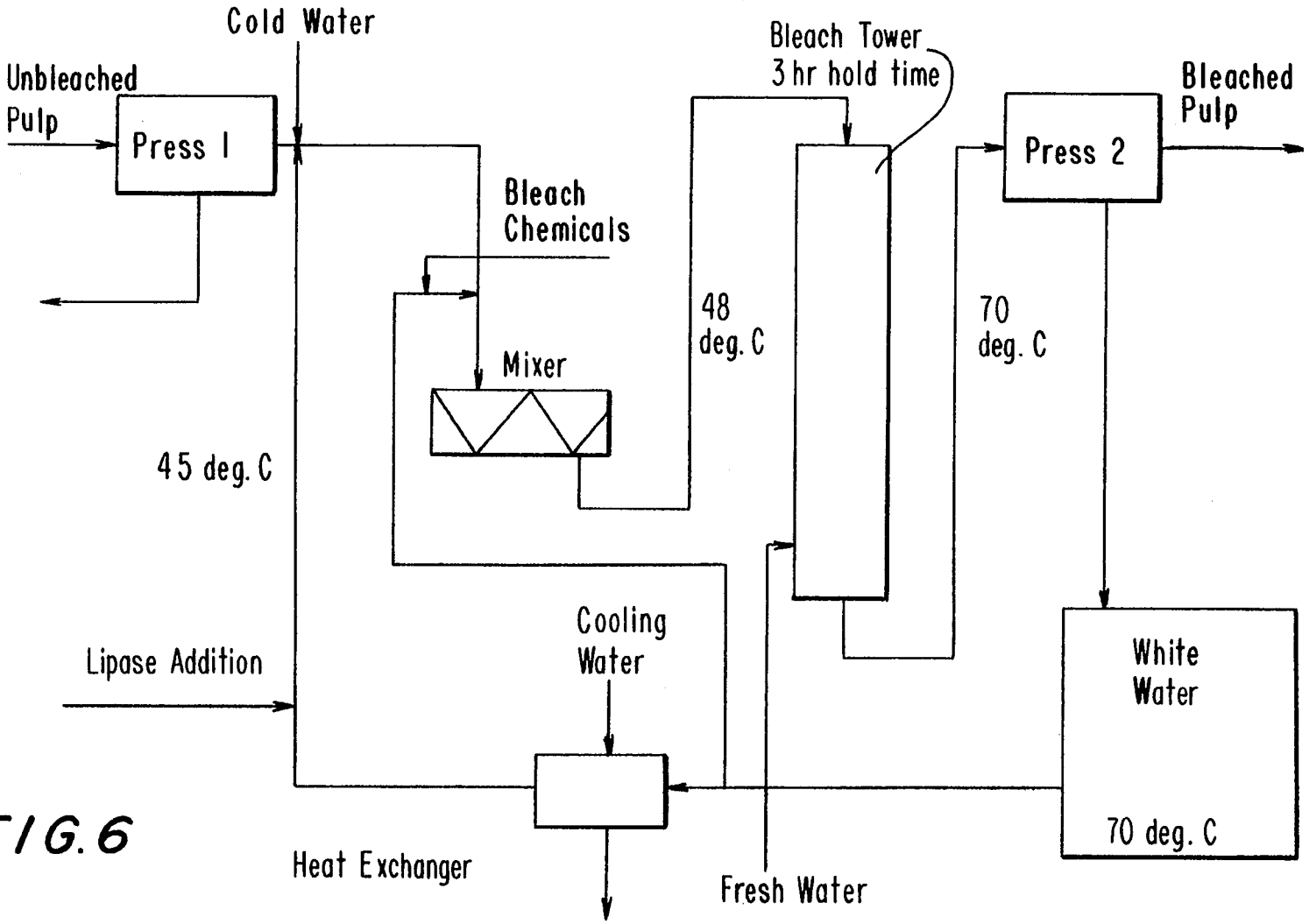
FIG. 6 is a flow sheet of the embodiment for the simultaneous treatment with lipase and peroxide.

The unbleached CTMP pulp was treated with lipase during peroxide bleaching in order to decrease the triglyceride content of the pulp and thereby improve the water absorbance properties of the pulp. The setup for the simultaneous lipase treatment and peroxide bleaching is illustrated in FIG. 6.

The lipase solution was added to the recycled bleaching liquor, which was used for dilution of the unbleached pulp after press 1. The temperature of the recycled stream to which the lipase solution was added was reduced to 45° C. in a heat exchanger.

After the lipase addition the pulp was then mixed with the bleaching chemicals normally used for peroxide bleaching. These are hydrogen peroxide, sodium silicate, magnesium sulfate, sodium hydroxide and complexing agent. The bleaching was performed at 15 to 17% consistency for 2.5 to 3 hours.

The triglyceride and fatty acid contents were analysed in samples taken from the white water after press 2 and in sample of the bleached pulp coming from press 2. The results are listed in the Tables 1 and 2, and the ratio between triglyceride and fatty acid (TG/FA) is plotted in FIG. 7 versus time.

The addition of the lipase (Resinase TM A) was started at 17:00 using 1 kg/t on dry pulp. After 6 hours (23:00) it was decreased to 0.8 kg/ton dry pulp.

Figure 7:
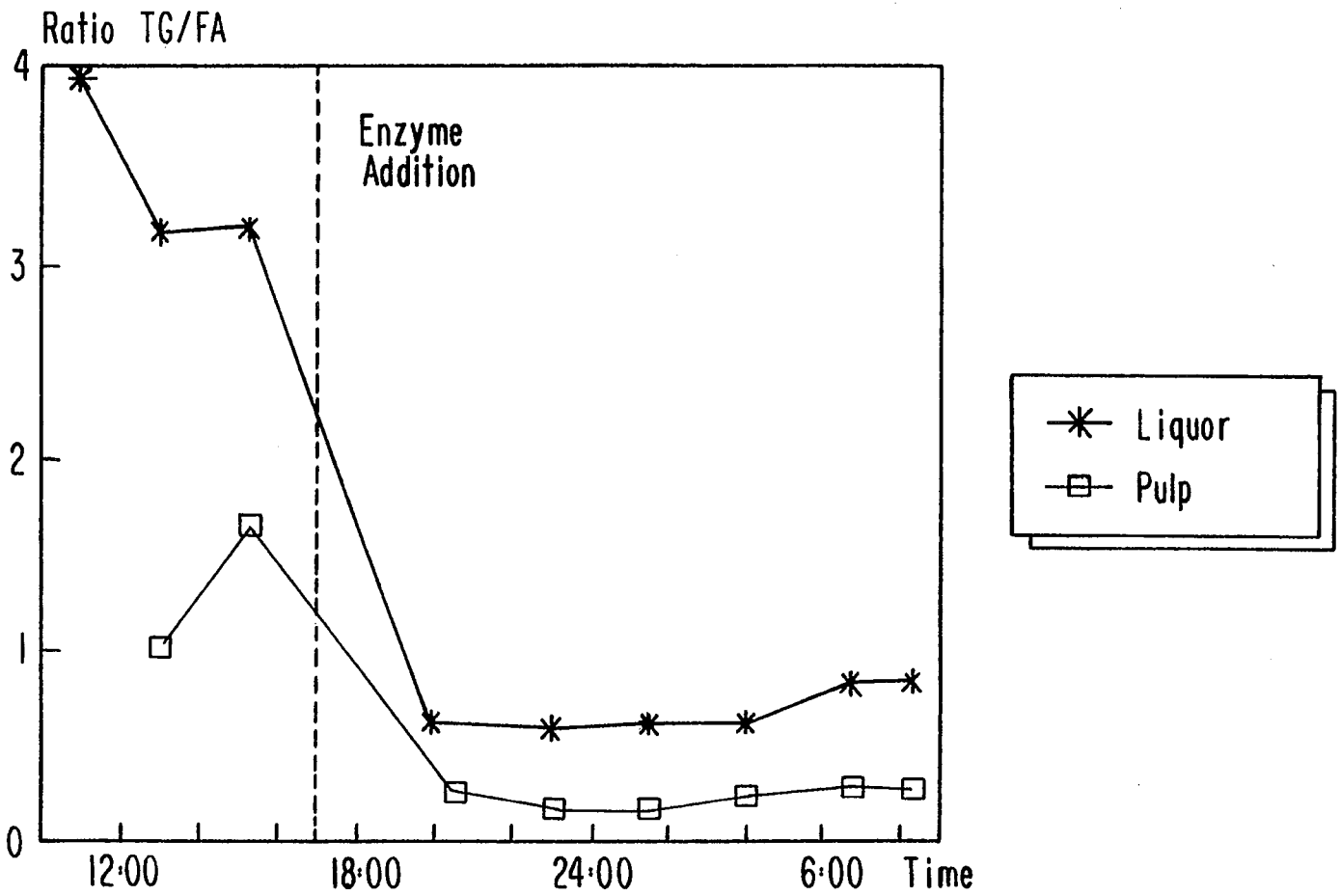
FIG. 7 shows a plot of the ratio of triglyceride and fatty acid content over time.

In FIG. 7 it is clearly seen that the triglyceride/fatty acid ratio is reduced considerably in both the pulp and the white water. In the recycled water (the white water) the ratio is decreased from approx. 4 before the lipase addition to approx. 0.6 after the additions started. For the bleached pulp (denoted pulp) the ratio is decreased from approx. 1.5 down to approx. 0.22.

Figure 8:
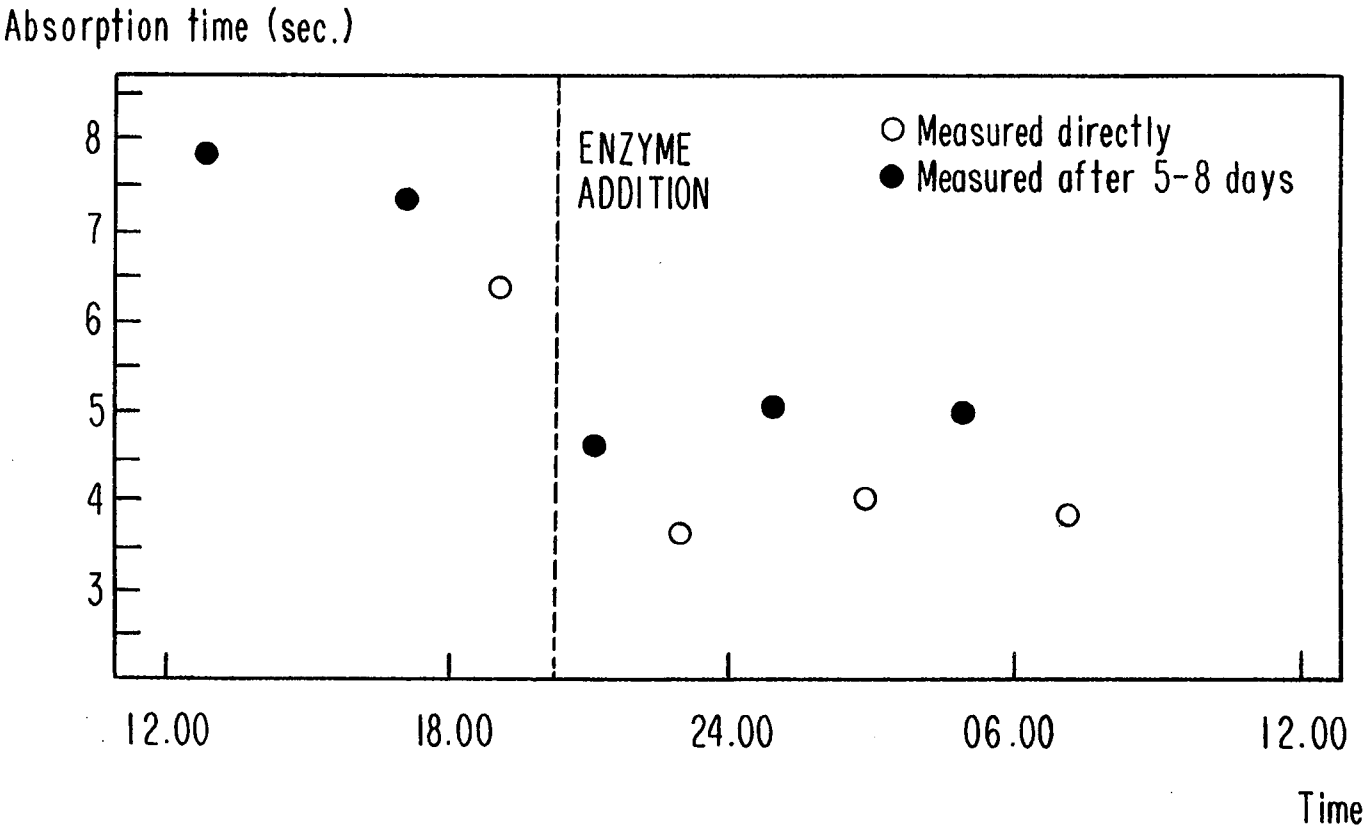
FIG. 8 shows a plot of adsorption time over time.

This reduction in triglyceride content in the bleached pulp improves the water absorbance properties of the fluff mass considerably. From FIG. 8, which shows the water absorption speed of the CTMP-fluff, measured according to SCAN C33:80, it is seen that the absorbance time of the pulp is reduced considerably after a lipase treatment. This counts both for the water absorbance speed measured directly on the fresh CTMP-fluff and also for the absorbane speed of the fluff after storage for a few of days. The lipase treatment of the fluff reduces the absorption time by 3 and 4 seconds coresponding to a reduction of 45 to 50 percent.

TABLE 1

| | Recycled bleach liquor from press 2 | | | |
|---|---|---|---|---|
| Time | DCM-extract (mg/l) | Triglycerides (mg/l) | Fatty acids (mg/l) | TG/FA ratio |
| 11.00 | 71 | 19.4 | 4.93 | 3.93 |
| 13.00 | 83 | 27.8 | 8.80 | 3.16 |
| 15.20 | 88 | 29.9 | 9.39 | 3.18 |
| 20.00 | 88 | 15.9 | 26.0 | 0.61 |
| 23.00 | 91 | 15.0 | 25.3 | 0.59 |
| 01.30 | 83 | 12.8 | 20.5 | 0.62 |
| 04.00 | 108 | 16.1 | 26.2 | 0.61 |
| 06.45 | 103 | 19.8 | 24.0 | 0.83 |
| 08.20 | 87 | 14.4 | 17.5 | 0.82 |

TABLE 2

| | Bleached pulp | | | |
|---|---|---|---|---|
| Time | DCM-extract (mg/l) | Triglycerides (mg/l) | Fatty acids (mg/l) | TG/FA ratio |
| 13.00 | 1.00 | 0.10 | 0.10 | 2.5 |
| 15.20 | 0.90 | 0.18 | 0.11 | 1.6 |
| 20.30 | 1.10 | 0.06 | 0.24 | 0.25 |
| 23.00 | 1.00 | 0.04 | 0.24 | 0.17 |
| 01.30 | 0.70 | 0.03 | 0.19 | 0.16 |
| 04.00 | 1.00 | 0.05 | 0.22 | 0.23 |
| 06.45 | 1.30 | 0.06 | 0.22 | 0.27 |
| 08.20 | 0.90 | 0.07 | 0.27 | 0.26 |

We claim:

1. A process for hydrolysis of resin in pulp during bleaching of the pulp, comprising enzymatically hydrolyzing the resin with an enzyme selected from the group consisting of lipase and esterase simultaneously with bleaching of the pulp with a peroxide, wherein the enzyme and the peroxide are present during the bleaching in amounts effective to hydrolyze resin in the pulp and bleach the pulp.

2. A process according to claim 1, wherein the pulp has a dry substance content of 5–30% by weight.

3. A process according to claim 2, wherein the dry substance content is 10–20%.

4. A process according to claim 1, wherein the enzyme is a microbial lipase derived from a strain of Candida, Pseudomonas, Humicola, Chromobacterium or Aspergillus.

5. A process according to claim 4, wherein the microbial lipase is present at an activity of 0.5–50 KLU/kg of pulp dry matter.

6. A process according to claim 1, wherein the hydrolysis is carried out at a cellulase activity which is below 1000 EGU/kg.

7. A process according to claim 1, wherein the peroxide is present at a concentration of 0.1–5.0% by weight, calculated as $H_2O_2$ in % of pulp dry matter.

8. A process according to claim 1, wherein the hydrolysis is carried out for a reaction time of 0.5–5 hours.

9. A process according to claim 1, wherein the hydrolysis is carried out at a pH of 8.0–11.5.

10. A process according to claim 1, wherein the hydrolysis is carried out at a temperature of 45°–65° C.

11. A process according to claim 1, further comprising subsequently draining and rinsing of the pulp at a pH above 7.0.

12. A process according to claim 1, wherein the pulp is mechanical pulp.

13. A process according to claim 12, wherein the mechanical pulp is chemithermomechanical pulp.

* * * * *